US008083562B2

(12) United States Patent
Mitani et al.

(10) Patent No.: US 8,083,562 B2
(45) Date of Patent: Dec. 27, 2011

(54) METHOD OF MANUFACTURING IMAGE DISPLAY APPARATUS USING SPUTTERING

(75) Inventors: Hiromasa Mitani, Hiratsuka (JP); Masato Muraki, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 370 days.

(21) Appl. No.: 12/355,376

(22) Filed: Jan. 16, 2009

(65) Prior Publication Data

US 2009/0203284 A1 Aug. 13, 2009

(30) Foreign Application Priority Data

Feb. 7, 2008 (JP) ..... 2008-027629

(51) Int. Cl.
*H01J 9/26* (2006.01)
*H01J 9/32* (2006.01)

(52) U.S. Cl. ..... 445/25; 445/24

(58) Field of Classification Search ..... None
See application file for complete search history.

(56) References Cited

U.S. PATENT DOCUMENTS

| | | | | |
|---|---|---|---|---|
| 5,716,618 | A * | 2/1998 | Tomida et al. | 427/126.1 |
| 5,905,335 | A * | 5/1999 | Fushimi et al. | 313/495 |
| 6,565,400 | B1 * | 5/2003 | Lee et al. | 445/25 |
| 6,836,302 | B2 * | 12/2004 | Sato | 349/46 |
| 7,108,573 | B2 | 9/2006 | Kamio et al. | 445/3 |
| 7,308,819 | B2 | 12/2007 | Kamio et al. | 73/23.2 |
| 2004/0008195 | A1 * | 1/2004 | Kawase | 345/204 |
| 2005/0179360 | A1 * | 8/2005 | Okamoto et al. | 313/495 |
| 2008/0174227 | A1 | 7/2008 | Kamio et al. | 313/485 |

FOREIGN PATENT DOCUMENTS

JP 2000-251778 9/2000

* cited by examiner

*Primary Examiner* — Toan Ton
*Assistant Examiner* — Britt D Hanley
(74) *Attorney, Agent, or Firm* — Fitzpatrick, Cella, Harper & Scinto

(57) ABSTRACT

A manufacturing method of an image display apparatus having a substrate and a conductive supporting frame formed at a periphery of the substrate includes steps of forming a wiring on the substrate, and forming an insulating layer on the wiring. The insulating layer includes a silicon nitride or a silicon oxide deposited by a sputtering technique. The insulating layer is seal-bonded with the conductive supporting frame.

8 Claims, 4 Drawing Sheets

METHOD OF MANUFACTURING IMAGE DISPLAY APPARATUS USING SPUTTERING

BACKGROUND OF THE INVENTION

1. Field of the Invention

The present invention relates to a method of manufacturing an image display apparatus having a hermetic structure.

2. Description of the Related Art

As high vacuum panels using thick film wiring, there are display panels equipped with a surface conduction electron-emitting device, a plasma display panel (PDP), a field emission display (FED), and the like.

Japanese Patent Application Laid-Open No. 2000-251778 discloses a configuration in which leading wires and a supporting frame are seal-bonded with each other with an insulating layer of a two-layer structure, and an insulating layer made of a material capable of impregnating the leading wires covers the seal-bonding portion of the leading wires.

The configuration disclosed in Japanese Patent Application Laid-Open No. 2000-251778 insists that vacuum tightness can be secured from air gaps in the wiring material, such as Ag.

However, if a material in a paste form is used as the insulating layer, the possibility of the occurrence of air bubbles in the inner part of the insulating layer is high, and there is the possibility that the vacuum leakage between the leading wires and the supporting frame is unavoidable.

Moreover, if an air gap portion owing to the air bubbles exists in the insulating layer when a conductive material is used as the supporting frame and the seal-bonding member, then the conductive material enters the air gap portion to cause an electric short circuit with the leading wires.

SUMMARY OF THE INVENTION

Accordingly, the present invention is directed to provide a method of manufacturing an image display apparatus capable of preventing any occurrence of vacuum leakage and electric short circuits.

An aspect of the present invention is a method of manufacturing an image display apparatus including a substrate and a supporting frame formed on an outer edge of the substrate, comprising the steps of: forming wiring on the substrate; forming an insulating layer on the wiring by one of a chemical vapor deposition (CVD) process and a sputter process; and seal-bonding the conductive supporting frame onto the insulating layer with a seal-bonding material. Moreover, another aspect of the present invention is a method of manufacturing an image display apparatus including a substrate, and a supporting frame formed on an outer edge of the substrate, comprising the steps of: forming wiring on the substrate; forming an insulating layer on the wiring by one of a CVD process and a sputter process; and seal-bonding the supporting frame on the insulating layer with a conductive seal-bonding material.

According to the aforesaid aspects of the present invention, any occurrence of vacuum leakage and electric short circuits can be prevented.

Further features of the present invention will become apparent from the following description of exemplary embodiments with reference to the attached drawings.

DESCRIPTION OF THE EMBODIMENTS

In the following, the exemplary embodiments of the present invention will be described with reference to the attached drawings.

The image display apparatus of the present invention has a hermetic structure. The present invention is applied to the image display apparatus having the configuration of a seal bonding portion thereof especially in which vacuum tightness is secured by a supporting frame and a seal-bonding material and leading wires are formed to cross the seal bonding portion on at least one side of a substrate between a side thereof to a face plate and a side thereof to a rear plate.

The image display apparatus includes a liquid crystal display apparatus, a plasma display apparatus, an electron beam display apparatus, and the like. In particular, the required degrees of vacuum of a field emitter and surface conduction electron-emitting element are high, and it is important to secure the vacuum tightness of their seal bonding portion. Consequently, the field emitter and the surface conduction electron-emitting element are preferable forms to which the present invention is applied.

First Embodiment

A first embodiment of the present invention will be specifically described below.

First, the whole configuration of a display panel to which the present invention is applied will be described.

Figure 1:
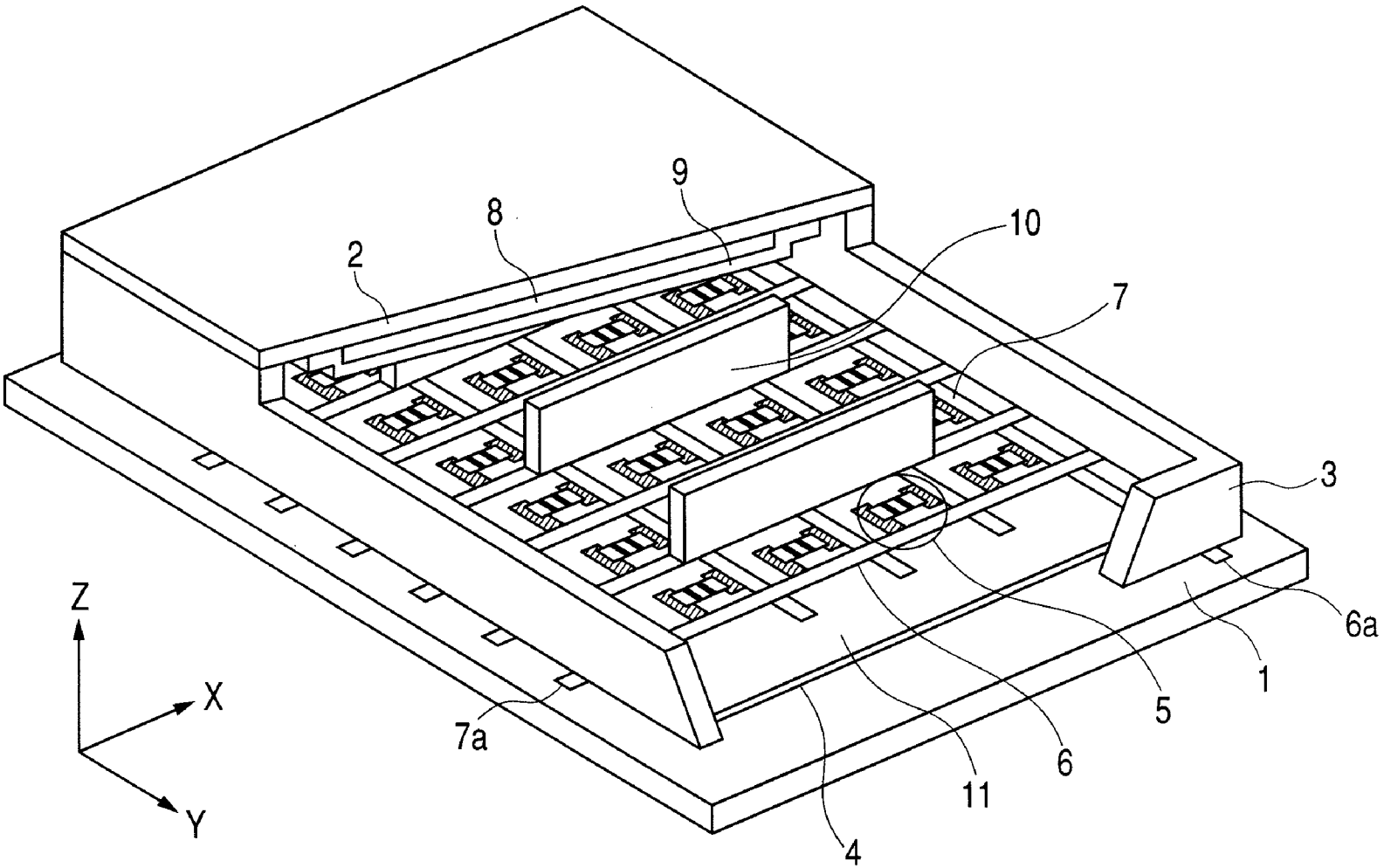
FIG. 1 is a partially broken perspective view illustrating an example of a display panel unit forming a plane type image display apparatus applicable to the present invention.

FIG. 1 is a perspective view illustrating an example of a display panel forming a plane type image display apparatus, and a part of the panel thereof is broken in order to illustrate the internal structure thereof. As illustrated in FIG. 1, the display panel includes a rear plate 1, a face plate 2, and a supporting frame 3 supporting the output edges of the rear plate 1 and face plate 2. The rear plate 1, the face plate 2, and the supporting frame 3 are bonded together with glass frit or the like to perform the seal-bonding of them, and thereby an envelope (hermetically sealed container) for keeping the inner part of the display panel in vacuum is formed.

A substrate 4 is fixed onto the rear plate 1, and (N×M) cold cathode elements 5 are formed in a matrix on the substrate 4, where each of the letters N and M is a positive integer of 2 or more and is suitably set according to the desired number of display pixels. Incidentally, it is unnecessary for the rear plate 1 and the substrate 4 to be separate members, but the cold cathode elements 5 may be formed on the rear plate 1.

Moreover, the (N×M) cold cathode elements 5 are wired with matrix wiring including M row direction wires 6 and N column direction wires 7 as illustrated in FIG. 1. A part composed of these substrate 4, cold cathode elements 5, row direction wires 6, and column direction wires 7 is called as a multi-electron beam source. Moreover, insulating layers (not illustrated) are formed between the row direction wires 6 and the column direction wires 7 at least in the parts where both the wires 6 and 7 intersect with each other, and electrical insulation between them is maintained.

Image forming members are disposed on the face plate 2. That is, a phosphor film 8 composed of phosphors is formed on the under surface of the face plate 2, and the phosphors (not illustrated) composed of the three primary colors of red (R), green (G), and blue (B) are separately applied on the phosphor film 8. Moreover, black bodies (not illustrated) are provided between the respective color phosphors constituting the phosphor film 8, and further a metal back 9 made of Al or the like is formed on the surface of the phosphor film 8 on the side of the rear plate 1.

Row direction terminals 6*a* and column direction terminals 7*a* are electric connection terminals for connecting the display panel to not illustrated electric circuits electrically, and the seal bonding at these parts is made in a hermetic structure, which is a feature, described below, of the present invention. The row direction terminals 6*a* are electrically connected to the row direction wires 6 of the multi-electron beam source. Moreover, the column direction terminals 7*a* are electrically connected to the column direction wires 7 of the multi-electron beam source.

The inner part of the hermetically sealed container is maintained in a vacuum of about $1.3\times10^{-4}$ Pa. Structure supporting members (called as spacers or ribs) 10 are things for preventing the deformation and breakage of the rear plate 1 and face plate 2, which deformation and breakage are caused by the difference of atmospheric pressures between the inner part of the hermetically sealed container and the outside thereof, and which are made of comparatively thin glass plates.

In the display panel configured as described above, the interval between the substrate 4, on which the multi-electron beam source is formed, and the face plate 2, on which the phosphor film 8 is formed, is generally kept to be submillimeter to several millimeters, and the inner part of the hermetically sealed container is kept in a high vacuum, as described above.

Next, the hermetic structure of the seal bonding portion, which is the feature of the display panel of the present invention, between the rear plate 1, on which the row direction terminals 6*a* and the column direction terminals 7*a* are formed, and the supporting frame 3 will be described. Incidentally, in the following description, the row direction terminals 6*a* and the column direction terminals 7*a* are collectively referred to as leading wires C.

Figure 2:
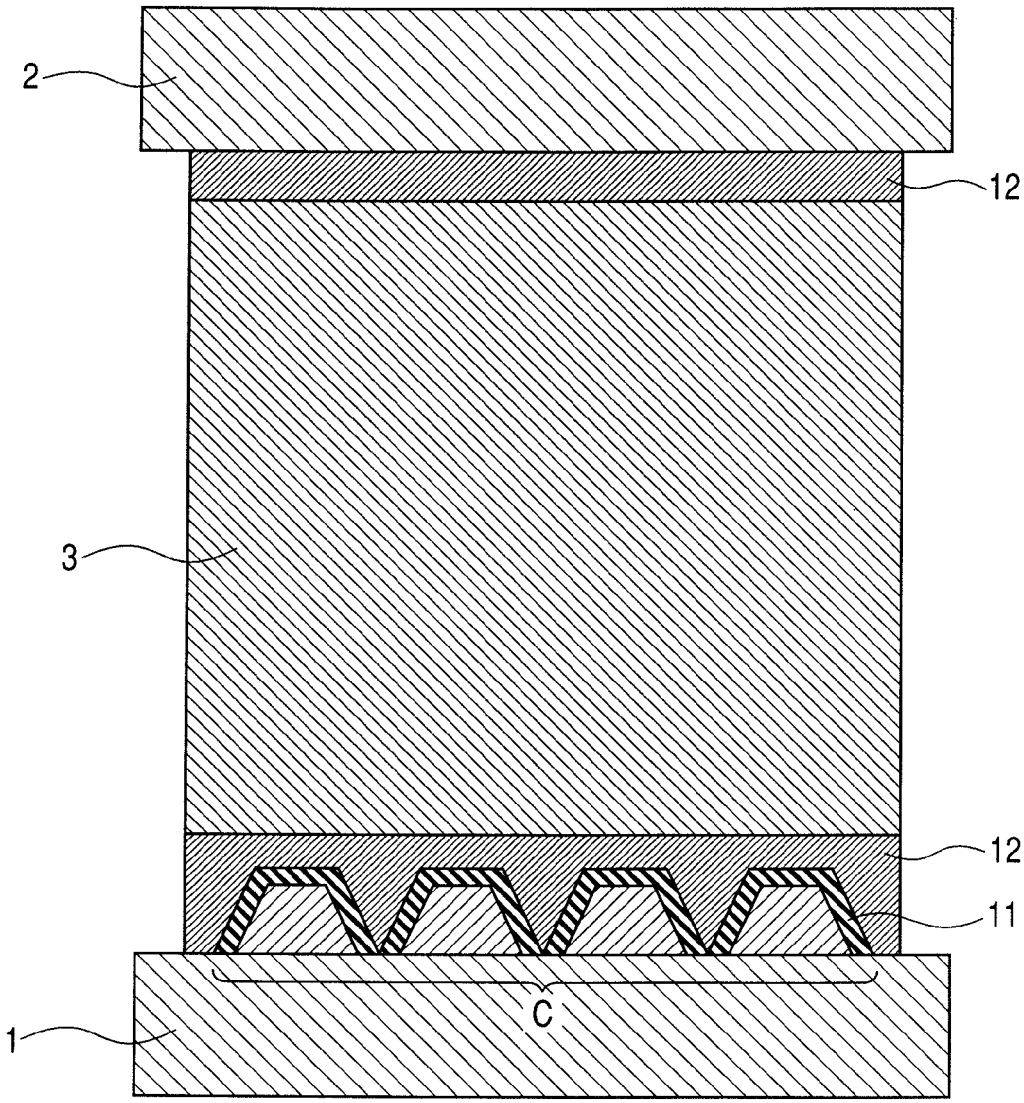
FIG. 2 is a partial sectional view of a display panel for illustrating the structure of the seal bonding portion of the rear plate and supporting frame of the display panel according to a first embodiment of the present invention.

FIG. 2 is a partial sectional view of the display panel of the present embodiment for illustrating the seal bonding portion between the rear plate 1 of the display panel and the supporting frame 3.

The rear plate 1 and the face plate 2 are arranged to be opposed to each other, and these plates 1 and 2 are seal-bonded with the supporting frame 3 put between them to form the hermetically sealed container.

In the following, the hermetic structure of the seal bonding portion between the rear plate 1 and the supporting frame 3 in the present embodiment will be described.

The plurality of leading wires C is parallely formed over the rear plate 1. A thin film insulating layer 11 formed by the CVD process or the sputter process is formed on each of the leading wires C. A seal-bonding material 12 is applied on the rear plate 1 and the thin film insulating layers 11. The rear plate 1 and the supporting frame 3 are seal-bonded with each other with the seal-bonding material 12. On the opposite side, to the one on which the rear plate 1 is seal-bonded, of the supporting frame 3, the face plate 2 is seal-bonded with the seal-bonding material 12.

The leading wires C electrically connected to the row direction wires 6 and column direction wires 7 cross the seal bonding portion in which the rear plate 1 is seal-bonded with the supporting frame 3 to be drawn out to the end of the rear plate 1. That is, the leading wires C are drawn out from the inner part of the hermetically sealed container to the outer part thereof through the seal bonding portion. Metal materials, such as Ag and Cu, are used for the materials of the leading wires C.

The thin film insulating layers 11 are formed on these leading wires C. The thin film insulating layers 11 are formed by the CVD process or the sputter process. If the film thicknesses of the thin film insulating layers 11 are secured to be 1 μm to 2 μm, a plasma CVD process is particularly preferable owing to its large film formation rate and short tact. Silicon oxide or silicon nitride is used as the materials of the thin film insulating layers 11. These $SiO_2$ and SiN are preferable as the materials of the thin film insulating layers 11 owing to their features of high volume resistivities and little gas emission.

Glass, metal, and the like are used as the material of the supporting frame 3, and the metal is more preferable owing to its easiness of molding and cheap price. In particularly, a material including any of Sn, In, and Ag is preferable as the material of the supporting frame 3.

A material including any of Sn, In, and Ag is preferable as the material of the seal-bonding material 12 for joining the rear plate 1 and the face plate 2 together. Glass frit, which is a general article on the market, can be given as the material of the seal-bonding material 12 in addition to a low melting point metal including In or Sn. However, since the glass frit has a melting point within a range from 400° C. to 550° C., the glass frit is used for high-temperature seal bonding. Consequently, it is difficult to maintain alignment accuracy in case of using the glass frit. Hence, it is more desirable to use a low melting point metal including In or Sn, which enables lower temperature seal bonding, as the material of the seal-bonding material 12. If In, Sn, or alloys of them is used as the seal-bonding material 12, it is effective to use a paste of Ag or Ni after the baking thereof. Incidentally, since the paste is a mixture of a metal and a glass frit, the paste is generally a conductive material. However, as described below, since the present embodiment is provided with the thin film insulating layers 11, electric insulation properties between the seal-bonding material 12 and the leading wires C are secured.

The seal bonding portion of the form illustrated in FIG. 2 has the configuration in which the leading wires C and the seal-bonding material 12 contact with each other with the thin film insulating layers 11 put between them. Consequently, no defects, such as a pinhole, can be allowed for the thin film insulating layers 11 in order to prevent any electrical short circuits. Accordingly, it is not preferable to form the thin film insulating layers 11 with the paste materials, in which pinholes are easily produced. Moreover, if some air gap portions exist in the thin film insulating layers 11 when the conductive materials are used for the supporting frame 3 and the seal-bonding material 12, then there is also the possibility that the conductive materials enter the air gap portions, and that the entered conductive materials cause electric shirt circuits to the leading wires C.

Accordingly, the present invention uses the materials, such as $SiO_2$ and SiN, each of which has a high volume resistivity and emits little gasses producing air bubbles, as the thin film insulating layers 11, and forms the thin film insulating layers 11 by the CVD process or the sputter process. Thereby, the thin film insulating layer 11 having no pinholes can be provided between each of the leading wires C and the seal-bonding material 12.

As described above, the present embodiment forms the thin film insulating layers 11 having no pinholes, and thereby the present embodiment prevents the occurrence of any vacuum leakage, electric short-circuits between the leading wires C and the supporting frame 3, and electric short-circuits between the leading wires C and the seal-bonding material 12.

Second Embodiment

Figure 3:
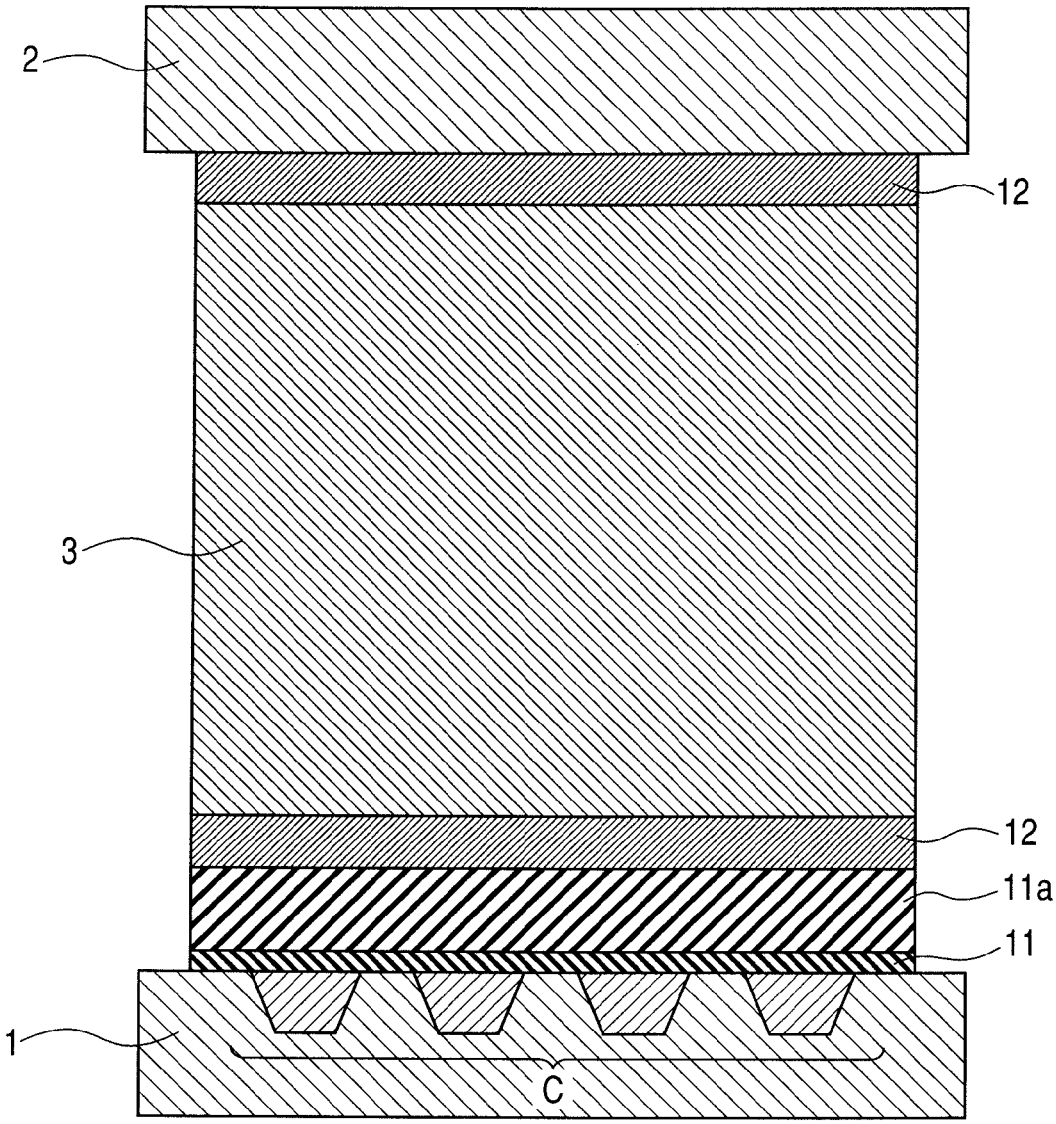
FIG. 3 is a partial sectional view of a display panel for illustrating the structure of the seal bonding portion of the rear plate and supporting frame of the display panel according to a second embodiment of the present invention.

FIG. 3 is a partial sectional view of the display panel of the present embodiment for illustrating the structure of the seal bonding portion between the rear plate 1 of the display panel and the supporting frame 3.

In the first embodiment, the leading wires C are formed on the flat rear plate 1. On the other hand, the present embodiment is different from the first embodiment in that grooves are formed on the rear plate 1 and the leading wires C are provided in the grooves, and in that a thick film insulating layer 11*a* is further formed on the thin film insulating layer 11 by a printing process. Incidentally, since the other aspects of the hermetic structure of the image display apparatus of the present embodiment are basically the same as those of the first embodiment, the description of their details are omitted. Moreover, descriptions will be given by using the marks that are also the same ones as those of the first embodiment.

In the following, the hermetic structure of the seal bonding portion between the rear plate 1 and the supporting frame 3 of the present embodiment will be described.

In the present embodiment, the leading wires C are formed on the rear plate 1 on which the grooves are formed. That is, the plurality of grooves is formed on the rear plate 1, and the leading wires C are formed in the respective grooves to make the surface of the rear plate 1 flat. The thin film insulating layer 11 is formed on such rear plate 1 and leading wires C. Furthermore, the thick film insulating layer 11*a* is formed on the thin film insulating layer 11. The seal-bonding material 12 is applied on the thick film insulating layer 11*a*, and the rear plate 1 and the supporting frame 3 are seal-bonded by the seal-bonding material 12. The face plate 2 is seal-bonded with the seal-bonding material 12 on the side of the supporting frame 3 opposite to the side of the seal bonding of the rear plate 1.

The present embodiment has the configuration in which the leading wires C are embedded in the inner part of the grooves formed on the rear plate 1, and thereby makes the surface of the rear plate 1*a* flat one without any irregularities. If ultrasonic waves are used for a measure of improving the wettability at the time of applying the seal-bonding material 12, such a flat formation enables the reduction of the damage owing to the impacts of the ultrasonic waves.

Moreover, the hermetic structure of the present embodiment further adds the thick film insulating layer 11*a* using a paste onto the thin film insulating layer 11 to make the insulating layer a two-layer configuration of the thin film insulating layer 11 and the thick film insulating layer 11*a*. If the insulating layer is formed by the CVD process or the sputter process, the realistic process upper limit value of the film thickness is several μm. The pasting in the printing process easily enables the formation of the insulating layer having the film thickness of up to several tens μm. The thick film insulating layer 11*a* formed by means of such a printing process can be expected to have an advantage of moderating the impacts by the ultrasonic waves at the time of applying the seal-bonding material 12 in addition. That is, if there are air bubbles in the inner part of the insulating layer, it can be suppressed that the insulating layer between the air bubbles is broken by the impacts of the ultrasonic waves and thereby the air bubbles advance to larger air bubble, and consequently the electric short-circuits can be more effectively prevented.

The material of the thick film insulating layer 11*a* includes a glass component, which melts by being baked at a high temperature of about 500° C. and forms the insulating layer by solidification again in the process of cooling to a room temperature. It is preferable to use a Bi series glass frit as the glass component.

Furthermore, an adhesion layer (not illustrated) may be formed between the seal-bonding material 12 and the thick film insulating layer 11*a* in order to improve the adhesion force between them.

If the seal bonding portion is formed to have the configuration mentioned above, the electric short-circuits arising between the seal-bonding material 12 and the leading wires C and between the supporting frame 3 and the leading wires C can be prevented at extremely high reliability. Moreover, the high reliability also can be secured from the point of view of securing a vacuum tightness.

EXAMPLES

In the following, the present invention will be minutely described by using concrete examples.

A manufacturing process of the image display apparatus having the structure illustrated in FIG. 1 will be described with reference to FIGS. 4A, 4B, 4C, 4D, 4E and 4F. Incidentally, the hermetic structure of the image display apparatus was the one illustrated in FIG. 3, which has been described with regard to the second embodiment.

(Wiring Formation)

Figure 4A:
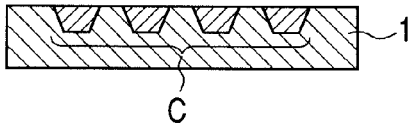
FIGS. 4A, 4B, 4C, 4D, 4E and 4F are views for illustrating a manufacturing process of the image display apparatus of the present invention.

First, the method of forming the leading wires C on the rear plate 1 will be described (FIG. 4A).

A resist was applied onto the rear plate 1 at the stage of a glass substrate, which was the basic material, and the resist only in the parts where the row direction wires were to be formed was opened through exposure and development processes.

Next, HF or a mixed liquid thereof was applied on the rear plate 1 by a spray process to etch the glass, and thereby grooves were formed. A rinse process was performed at the stage at which necessary depths of the grooves (20 μm in the present example) had been obtained, and the etching liquid was washed out. After that, the resist was exfoliated.

Successively, Cu was stacked on the whole surface of the substrate by an electroless plating process, an electrolytic plating process, or the like. The film thickness of the stacked Cu layer was set to 25 μm because the film thickness was necessary to be deeper than the depths of the grooves formed in advance.

Successively, the grinding of the stacked Cu was stepwise advanced by a chemical-mechanical polishing (CMP) process. The CMP process was ended at a time point at which the grinding had reached the surface where no grooves had been formed at the time of the glass etching. As a result, the shape in which Cu was embedded only in the groove portions was obtained. As illustrated in FIG. 4A, a flat shape with no irregularities on the surface was realized.

(Formation of First Insulating Layer)

Figure 4B:
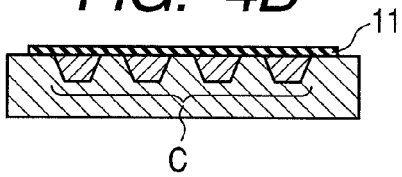

Next, the thin film insulating layer 11 was formed on the rear plate 1 (FIG. 4B). As the material of the thin film insulating layer 11, $SiO_2$, which had a high volume resistivity and little gas emission, was selected. As the forming process, the plasma CVD process, which had a large film formation rate, was adopted, and the thin film insulating layer 11 was formed to have a film thickness of 1 μm to 2 μm.

(Formation of Second Insulating Layer)

Figure 4C:
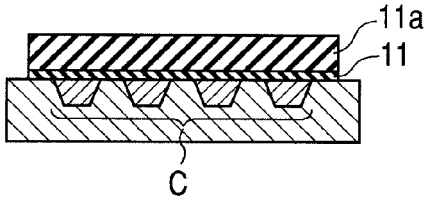

Successively, an insulative paste including glass frit was printed on the thin film insulating layer 11 by a screen printing process to form the thick film insulating layer 11*a* (FIG. 4C). The film thickness thereof was several μm to several tens μm. A paste including a Bi series glass frit was adopted here, and the thick film insulating layer 11*a* was formed.

(Formation of Frame Undercoat)

Successively, an adhesion layer (not illustrated) was formed. That time the adhesion layer was formed in the region where the seal-bonding material 12 was to be applied in the process described below by a pattern printing process. An Ag paste was used as the formation of the adhesion layer, and the Ag paste was baked at 480° C.

An insulating layer using a conventional paste material had a high possibility of the occurrence of an electric short-circuit in the seal bonding portion thereof after baking. The cause of the electric short-circuit was known as follows: the Ag paste entered an air bubble to cause swelling and shrinking through further baking, and further the breakage owing to stress advanced to the occurrence of the electric short-circuit. In the present example, since the thin film insulating layer 11 was formed of $SiO_2$ formed by the CVD process, the occurrence of the electric short-circuit could be prevented.

(Application of Seal-Bonding Material)

Figure 4D:
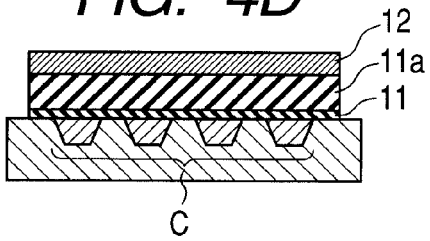

Successively, the seal-bonding material 12 was applied on the adhesion layer (FIG. 4D). An ultrasonic soldering process was effective as the application process.

As the seal-bonding material 12, a Sn series metal material having a melting point of about 250° C. was adopted. The metal material was heated to 300° C. to be melted, and was applied by the ultrasonic soldering process.

The conventional insulating layer using the paste had the high possibility of the occurrence of an electric short-circuit after the application of the paste. The cause of the occurrence of the electric short-circuit was known as follows: a melted soldering material entered an air bubble by the vibrations of ultrasonic waves, and then the electric short-circuit was produced. Moreover, the air bubble itself was broken by the vibrations caused by the ultrasonic waves, and advanced to a larger air bubble, and further the electric short circuit was produced in a wide region.

In the present example, even if an air bubble was included in the pasted thick film insulating layer 11*a*, the occurrence of the electric short-circuit could be prevented by adding the thin film insulating layer 11 of $SiO_2$ formed by the CVD process. Moreover, since the thick film insulating layer 11*a* fills the role of moderating an impact, the occurrence of failures, such as the breakage and the exfoliation, of the thin film insulating layer 11 can be prevented.

(Fabrication of Spacer)

The structure supporting members 10 (not illustrated in FIGS. 4A, 4B, 4C, 4D, 4E and 4F) were fixed onto the rear plate 1, which had been completed through the processes mentioned above. As their materials, a glass having the same swelling factor as that of the basic material of the glass of the rear plate 1 was adopted. The thicknesses of the structure supporting members 10 were thin of several tens μm to several hundreds, which was a result of the consideration of exerting no bad influences on the image quality of the image display apparatus.

(Fabrication of Supporting Frame)

Figure 4E:
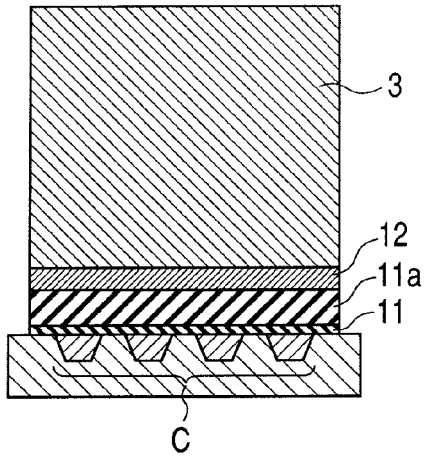

The supporting frame 3 was fixed in the seal bonding portion (FIG. 4E). The shape of the supporting frame 3 was adopted to be a flat type, and a metal material, which was easy to mold and cheap, was used as the material of the supporting frame 3.

(Fabrication of Face Plate)

Figure 4F:
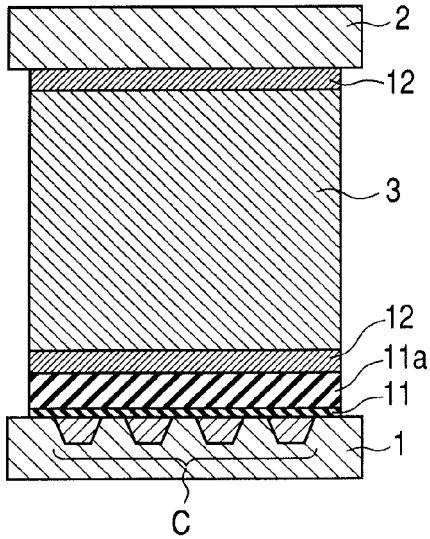

An adhesion layer was formed also in the seal bonding portion of the face plate 2 by the pattern printing process similarly to the rear plate 1, and further the seal-bonding material 12 was applied (FIG. 4F). As also the seal-bonding material on the side of the face plate 2, the Sn series metal material having a melting point of about 250° C. was adopted similarly to the side of the rear plate 1. The seal-bonding material 12 was applied by the ultrasonic soldering method in the heated (up to 300° C.) and melted state. Incidentally, in the present example, since no wiring existed on the side of the face plate 2, there was no need to provide any insulating layers.

(Panelization)

Last, as a panelization process, the rear plate 1 and the face plate 2 were seal-bonded. As a measure of the seal bonding, the seal bonding in a vacuum chamber, which was advantageous for shortening an exhaust time, was adopted. The rear plate 1 and the face plate 2 were opposed to each other to be positioned at positions where the cold cathode elements 5 and the phosphor were exactly opposed on the basis of alignment marks marked on both of the rear plate 1 and the face plate 2 in advance, and after that the seal bonding process was started. In order to melt the seal-bonding material 12, electrification was performed to the supporting frame 3, and only the seal bonding portion was heated to 300° C. by the resistance heating. After that the cooling thereof was performed, and the re-solidification was performed. Then, the panel was taken out.

(Evaluation of Panel)

The image display apparatus produced by the method mentioned above was mounted on a driver, and the evaluation of the image quality thereof was performed. Since the image display apparatus of the present invention adopted the thin film insulating layer 11, the occurrence of any electric short-circuits in the seal bonding portion could be prevented. Moreover, also the degree of vacuum in the panel of the image display apparatus of the present invention adopting the thin film insulating layer 11 was extremely good, and the occurrence of the vacuum leakage in the seal bonding portion could be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-027629, filed Feb. 7, 2008, which is hereby incorporated by reference herein its entirety.

What is claimed is:

1. A manufacturing method of an image display apparatus comprising a substrate and a supporting frame formed at a periphery of the substrate, the method comprising steps of:

forming a wiring on the substrate;

forming an insulating layer directly on the wiring, the insulating layer including a silicon nitride or a silicon oxide deposited by a sputtering technique; and seal-bonding the insulating layer with the supporting frame via a conductive seal-bonding material.

2. The method according to claim 1, wherein the supporting frame contains Sn, In or Ag.

3. The method according to claim 1, wherein the seal-bonding material contains Sn, In or Ag.

4. The method according to claim 1, further comprising a step of forming a further insulating layer by a printing process on the insulating layer formed by sputtering, wherein the seal-bonding step is conducted by seal-bonding the supporting frame on the further insulating layer formed by the printing process.

5. The method according to claim 1, wherein the insulating layer is formed from silicon oxide or silicon nitride on the wiring by sputtering.

6. The method according to claim 1, wherein the step of forming the wiring is conducted by forming the wiring containing Ag or Cu on the substrate.

7. A manufacturing method of an image display apparatus comprising a substrate and a supporting frame formed at a periphery of the substrate, the method comprising steps of:

forming a groove on the substrate;

forming a wiring into the groove of the substrate;

flattening a surface of a portion of the wiring;

forming an insulating layer directly on the flattened portion, the insulating layer including a silicon nitride or a silicon oxide deposited by a CVD technique or a sputtering technique;

seal-bonding the insulating layer with the supporting frame via a seal-bonding material; and wherein at least one of the supporting frame or the seal-bonding material is conductive.

8. A manufacturing method of an image display according to claim 7, further comprising a step of applying an ultrasonic vibration to the seal-bonding material during the seal-bonding step.

* * * * *